United States Patent [19]

Nelson

[11] 4,305,228

[45] Dec. 15, 1981

[54] OPERATOR FOR A CASEMENT-TYPE WINDOW

[75] Inventor: Eric W. Nelson, Minneapolis, Minn.

[73] Assignee: Truth Incorporated, Owatonna, Minn.

[21] Appl. No.: 44,002

[22] Filed: May 31, 1979

[51] Int. Cl.[3] ..... E05D 15/30; E05F 11/00

[52] U.S. Cl. ..... 49/252; 49/324; 49/342

[58] Field of Search ..... 49/246, 248, 249, 250, 49/252–253, 260, 261, 346, 341–343, 345, 324

[56] References Cited

U.S. PATENT DOCUMENTS

| | | | |
|---|---|---|---|
| 1,302,765 | 5/1919 | Carrier | 49/246 |
| 2,797,917 | 7/1957 | Lickteig, Jr. et al. | 49/250 X |
| 2,926,399 | 3/1960 | Ramunas | 49/248 |
| 2,948,027 | 8/1960 | Gill, Jr. et al. | 49/425 X |

FOREIGN PATENT DOCUMENTS

| | | | |
|---|---|---|---|
| 481936 | 3/1938 | United Kingdom | 49/341 |

*Primary Examiner*—Philip C. Kannan

*Attorney, Agent, or Firm*—Wegner, Stellman, McCord, Wiles & Wood

[57] ABSTRACT

An operator for a casement-type window having a frame and a sash mounted by a slider adjacent an edge of the sash for rotational opening and closing movement about a slider pivot axis with linear movement of the slider. The operator has a first sector gear fixed to the sash with the gear center offset relative to said slider pivot axis and a second gear meshing with the sector gear and functioning as a drive gear with a first link functioning to hold said gears in meshed relation and a constraining link connectable between the sash and the window frame with the constraining link and said first link acting to guide the opening and closing movements of the sash.

8 Claims, 3 Drawing Figures

OPERATOR FOR A CASEMENT-TYPE WINDOW

BACKGROUND OF THE INVENTION

This invention pertains to an operator for a casement-type window and, more particularly, to a torque operator which causes movement of the window sash by application of torque to have a force applied that is maintained most consistently perpendicular to a ray from the center of the driven gear connected to the window sash.

A casement-type window has the sash mounted adjacent one edge at the top and bottom thereof on slider structure whereby, in the opening and closing movements of the window, said edge of the sash has both combined linear and pivotal movements with the linear movement being controlled by movement of the sliders along associated channel members fixed to the window frame. A constraining link is connected between the sash and the window frame for guiding the sash movement. A window of this general type is shown in Gill U.S. Pat. No. 2,948.027.

Typically, a casement-type window operator has a manually-operated pivotal operator arm which is either directly or indirectly connected to the window sash for causing opening and closing movement thereof. Such structures require consideration of the various angles at which the operator arm transmits force to the window sash, taking into account the window action as one edge of the window sash is movable linearly by the sliders moving in the guide channels.

Applying a window opening and/or closing force to a gear directly associated with the window sash avoids the problems encountered with a pivotally-mounted operator arm. Carrier U.S. Pat. No. 1,302,765 shows a casement window with a sector gear associated therewith which is operable by a worm to cause opening and closing movement of the window. In this patent, the sector gear has its effective center coaxial with the pivot mounting for the window sash and the disclosed structure would not operate with a casement-type window wherein the pivotally-mounted edge of the sash has linear movement as well as pivoting movement during opening and closing of the window.

SUMMARY OF THE INVENTION

A primary feature of the invention disclosed herein is to provide an operator for a casement-type window which is an efficient design in driving the window with a torque and avoids the use of a conventional pivotal operator arm.

In carrying out the foregoing, the casement-type window has an edge pivotally mounted to linearly movable sliders and the torque operator includes a drive gear and a meshing sector gear with the latter gear fixed to the window sash whereby, as the driven gear orbits around the drive gear, the sash moves between open and closed positions with said edge of the sash moving linearly with the sliders. Additionally, a first link acts to maintain the gears in meshed relation and functions together with a constraining link connected between the sash and the window frame to guide the sash in its opening and closing movement.

An object of the invention is to provide a new and improved torque operator for a casement-type window wherein a sector gear fixed to the sash with the effective center thereof offset from a pivotal mounting point for the sash is engaged with a drive gear rotatable about a fixed axis and links are associated with the structure whereby rotation of the drive gear causes orbiting of the sector gear on the drive gear to cause opening and closing movement of the sash, with the movement thereof being guided by the links and with an edge of the sash moving generally linearly and parallel to the length of the window sill.

DESCRIPTION OF THE PREFERRED EMBODIMENT

Figure 2:
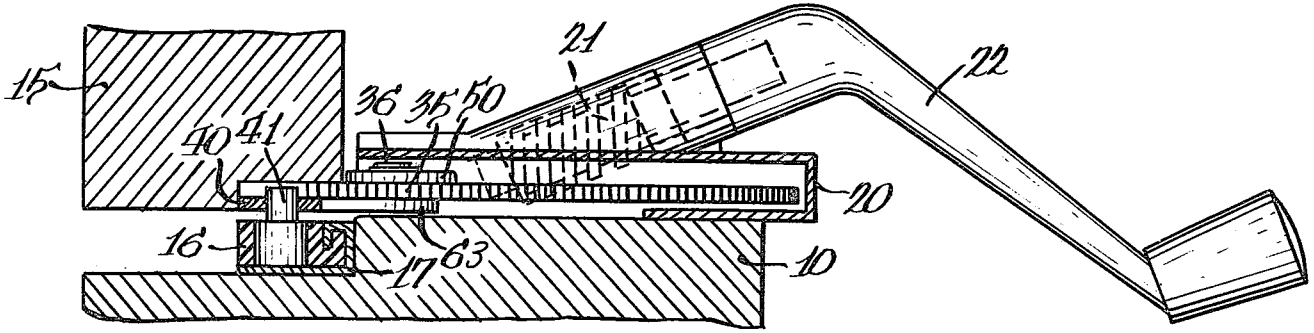
FIG. 2 is a vertical section, taken generally along the line 2—2 in FIG. 1 and on an enlarged scale.
Figure 3:
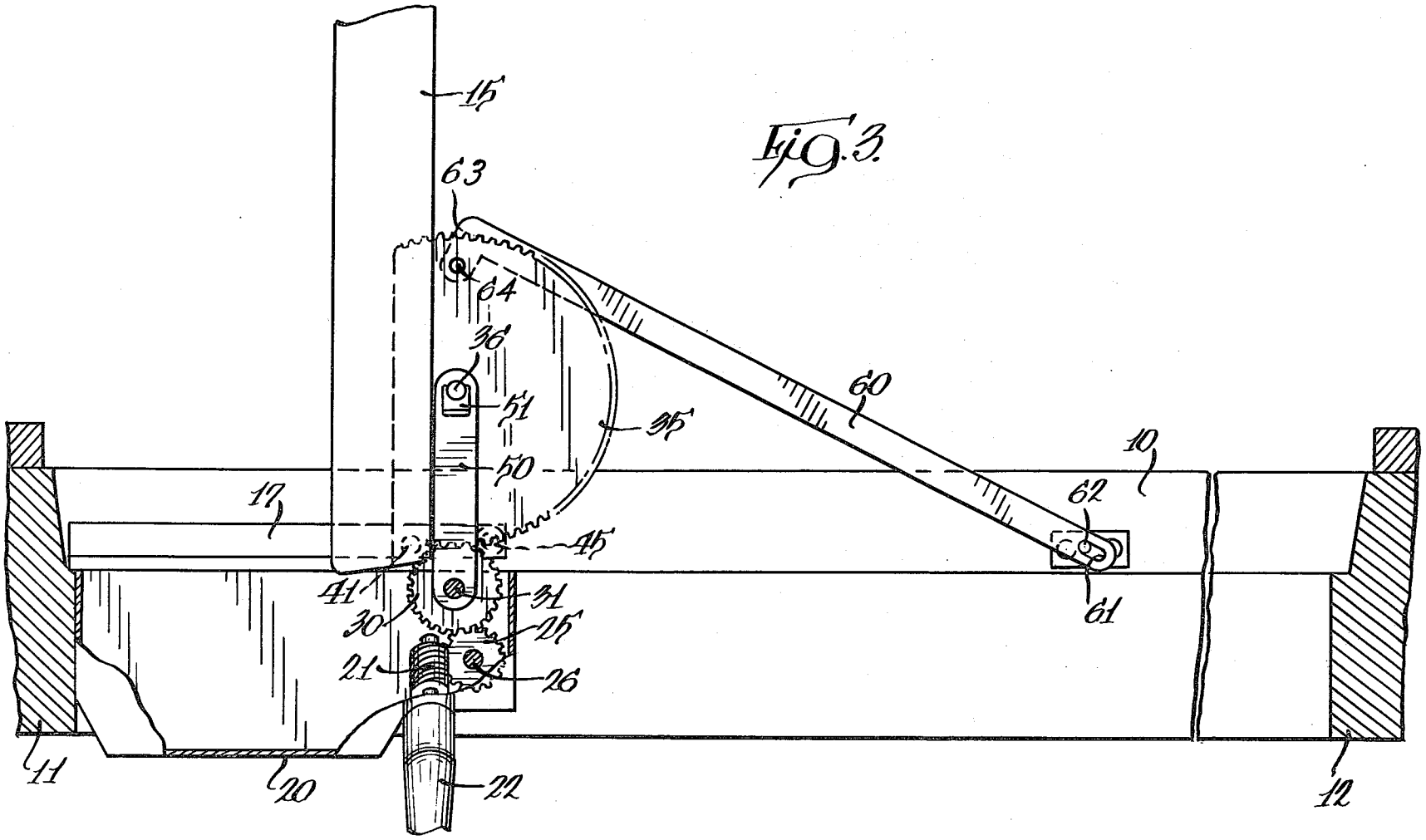
FIG. 3 is a view, similar to FIG. 1, showing the window in fully-open position.

A casement-type window is shown generally in the drawings wherein a sill 10 has a pair of side jambs 11 and 12 at opposite ends extending upwardly therefrom. A window sash 15 is mounted within the frame for movement between the closed position, shown in FIG. 1, and the fully-open position shown in FIG. 3. The sash is mounted for opening and closing movement which consists of both pivoting and linear movement thereof by slider structure mounted at both the top and bottom thereof adjacent one edge of the sash. As shown in FIG. 2, a slider 16 of the slider construction associated with the lower rail of the sash is movable within a track 17 fitted to the window sill 10. Structure of this type is more particularly shown and described in the aforesaid Gill patent and reference may be made thereto for a more detailed description of the slider structure. Typically, and as shown in the Gill patent, the slider is pivotally connected to the window sash. However, in the invention disclosed herein the pivoting between the sash and the slider is indirect through connecting structure to be described. In comparing FIGS. 1 and 3, it will be noted that the slider 16 moves in a linear path determined by the guide track 17 and in a direction which is generally parallel to the length of the window sill 10.

The window operator has a casing 20 which rotatably mounts an actuating worm gear 21 which is connected to a manually-operable crank 22 for causing rotation of the worm gear. The worm gear 21 drivingly engages a worm wheel 25 rotatably mounted within the casing on a shaft 26. The worm wheel 25 drivingly engages a drive gear 30 which is positioned generally within the casing 20 and rotatable about a fixed axis by mounting on a shaft 31. The drive gear 30 meshes with a sector gear 35 which has a pin 36 extending upward from the center of the sector gear radii. The sector gear 35 has a straight-line sector thereof underlying the bottom rail of the sash and suitable means, such as screws (not shown), extend through openings in the sector gear and thread into the underside of the sash for fixing the sector gear to the sash.

The sector gear has a tab 40 extending outwardly from the underside thereof to receive a pivot pin 41 extending upwardly from the slider 16 whereby the lower edge of the sash is pivotally mounted relative to the slider by connection to the sector gear 35 and the mounting of the latter to the pivot pin 41. There is a direct pivot connection of the slider to the top of the sash, as shown in the Gill patent. The Gill patent shows the slider as having a guide block with raised bosses. In this application, one of these bosses 45 is shown in its two positions relative to the track 17 in FIGS. 1 and 3.

A first link 50 overlies the drive gear 30 and the sector gear 35 and rotationally connects between the shaft 31 and pin 36 to hold the two gears in meshed relation and to coact with a second link for guiding the sash 15 in opening and closing movements. The link 50 has a release clip 51 whereby the link can be releasably connected to the pin 36. A constraining link 60 is pivotally connected between the sill 10 of the window frame and the sash 15. One end of the link is slotted, as shown at 61, to engage a frame-mounted pin 62 which permits limited lengthwise movement of the link. The opposite end of the link has an offset end 63 which is effectively connected to the sash by a pivot connection at 64 to the sector gear 35.

Figure 1:
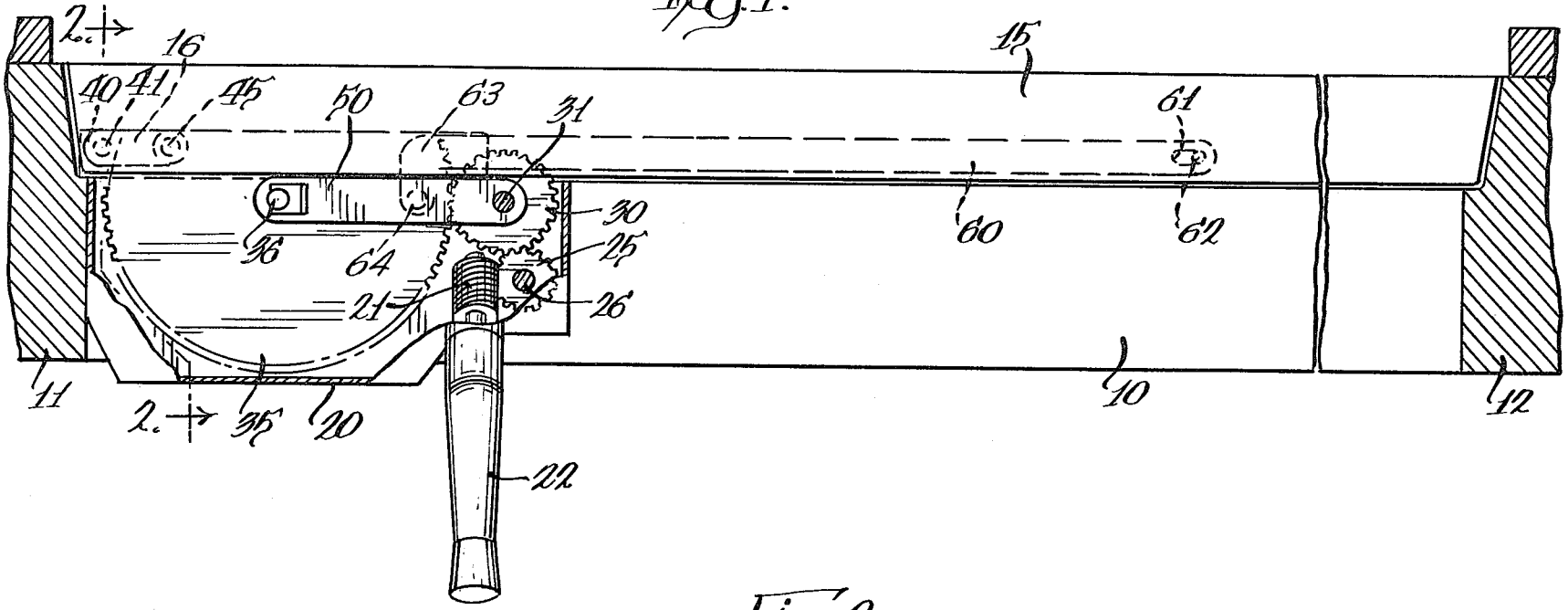
FIG. 1 is a plan view of the operator shown in association with a window with parts of the window and operator broken away.

With the window shown in closed position in FIG. 1, manual rotation of the crank 22 causes rotation of the worm wheel 25 to rotate the drive gear 30. Rotation of the drive gear 30 in a clockwise direction causes counterclockwise rotation of the gear sector 35 whereby the torque exerted through the gearing exerts a force to urge the sash 15 toward an open position with the sector gear 35 orbiting about the drive gear 30. As the movement continues toward the position of FIG. 3, the sash 15 pivots outwardly and, at the same time, the edge thereof which mounts the sector gear 35 moves generally linearly because of the travel of the slider 16 in the channel 17. The link 50 functions to hold the drive gear and the sector gear in meshing relation during the orbiting of the sector gear about the drive gear and also coacts with the constraining link 60 to guide the sash in opening and closing movement. To provide some freedom from overconstraint provided by the system, the slot 61 in the constraining link 60 permits some deviation by permitting limited lengthwise movement of the constraining link 60.

The sum of the radii of the drive gear 30 and the gear sector 35 is approximately equal to one-half the total translation required of the slider 16 along the guide track 17.

The torque operator provides an efficient and improved design. During wind loading against the open window, the force applied to the gear teeth is approximately less than 10% of the force applied to the gear teeth in a commercially available operator wherein a gear drives a pivotal operator arm, because there is a substantial force exertion on the constraining link 60 with a minimal amount of force applied to the gear teeth of the operator. This enables use of less substantial gears and also results in minimal transmittal of torque to the screws (not shown) which mount the casing 20 of the operator to the window sill to minimize the usual problem of stripping the casing from the sill by loosening of the screws.

I claim:

1. An operator for a casement-type window having a frame and sash mounted by a slider adjacent an edge of the sash for rotational opening and closing movement about a slider pivot axis with linear movement of said slider comprising, a first sector gear mounted on the sash and fixed in a stationary position on the sash for movement therewith with the gear center offset relative to said slider pivot axis, a second gear meshing with said sector gear, means holding said gears in meshed relation, and means for rotating said second gear for causing movement of said sash.

2. An operator as defined in claim 1 including a constraining link having one end pivotally connected to said frame and the other end pivotally connected and movable with the sash.

3. An operator as defined in claim 2 wherein said one end of the constraining link is also mounted for limited movement lengthwise thereof and said other end of the constraining link is pivotally connected to said sector gear.

4. An operator for a casement-type window having a sash mounted at an edge thereof for pivoting on a slider guided in a track for linear movement comprising, a drive gear mounted for rotation about a fixed axis, a driven gear meashing with said drive gear and connectable to said sash at a location whereby the driven gear orbits the drive gear during sash movement, a first link holding said gears in meshed relation, a second link connectable between the sash and a window frame whereby said links guide opening and closing of the sash with linear movement of the slider as the driven gear is caused to orbit along the drive gear, and means for rotating said drive gear.

5. An operator for a casement-type window having a frame and a sash mounted therein for rotational opening and closing movement with an edge of the sash mounted for pivoting on a slider guided in a track for linear movement comprising, a casing mountable to said frame, a drive gear rotatably mounted in said casing, a driven sector gear meshing with said drive gear and connectable to said sash at a location between said pivot mounting of the sash and said drive gear when the sash is closed, a pair of pins located one at the rotational center of each of said gears, a first link interconnected between said pair of pins, a second link slidably connected to said frame and to said driven gear whereby said links guide the opening and closing of the sash with linear movement of the slider as the driven gear is caused to orbit along the drive gear by rotation of the latter gear, and means for rotating said drive gear.

6. An operator as defined in claim 5 wherein the sum of the radii of said drive and driven gears is approximately equal to one-half the distance travelled by said slider between window closed and window fully-open positions.

7. An operator for a casement-type window having a frame and a sash mounted therein for rotational opening and closing movement with an edge of the sash mounted for pivoting on a slider guided in a track for linear movement comprising, a casing, a drive gear rotatably mounted in said casing, a driven gear meshing with said drive gear and connectable to said sash at a location between said pivot mounting of the sash and said drive gear when the sash is closed, a first link interconnecting said gears, and a second constraining link connectable between said frame and sash whereby said links guide opening and closing of the sash with linear movement of the slider as the driven gear is caused to orbit along the drive gear, and means for rotating said drive gear.

8. An operator as defined in claim 7 wherein said constraining link has a connection to the frame enabling a limited amount of lengthwise movement of the constraining link relative to the frame.

* * * * *